US009416433B2

(12) United States Patent
Miwa et al.

(10) Patent No.: US 9,416,433 B2
(45) Date of Patent: Aug. 16, 2016

(54) COPPER ALLOY STRIP FOR LEAD FRAME OF LED

(71) Applicant: Kobe Steel, Ltd., Kobe-shi (JP)

(72) Inventors: Yosuke Miwa, Shimonoseki (JP); Yasushi Masago, Shimonoseki (JP); Masayasu Nishimura, Shimonoseki (JP); Hideki Matsushita, Shimonoseki (JP)

(73) Assignee: Kobe Steel, Ltd., Kobe-shi (JP)

( * ) Notice: Subject to any disclaimer, the term of this patent is extended or adjusted under 35 U.S.C. 154(b) by 148 days.

(21) Appl. No.: 14/185,200

(22) Filed: Feb. 20, 2014

(65) Prior Publication Data

US 2014/0295212 A1 Oct. 2, 2014

(30) Foreign Application Priority Data

Mar. 27, 2013 (JP) ..... 2013-067387
Mar. 27, 2013 (JP) ..... 2013-067467

(51) Int. Cl.
*C22C 9/00* (2006.01)
*H01B 1/02* (2006.01)

(52) U.S. Cl.
CPC *C22C 9/00* (2013.01); *H01B 1/026* (2013.01); *Y10T 428/12993* (2015.01)

(58) Field of Classification Search
None
See application file for complete search history.

(56) References Cited

U.S. PATENT DOCUMENTS

| | | | | |
|---|---|---|---|---|
| 7,190,016 | B2 * | 3/2007 | Cahalen | H01G 4/005 257/296 |
| 2005/0161126 | A1 | 7/2005 | Aruga et al. | |
| 2008/0257581 | A1 | 10/2008 | Masago et al. | |
| 2009/0047539 | A1 * | 2/2009 | Dobashi | C25D 1/04 428/607 |
| 2009/0053553 | A1 | 2/2009 | Masago et al. | |
| 2009/0224379 | A1 | 9/2009 | Miwa et al. | |
| 2010/0247959 | A1 | 9/2010 | Taira et al. | |
| 2012/0039741 | A1 | 2/2012 | Aruga et al. | |
| 2012/0298183 | A1 | 11/2012 | Buresch et al. | |
| 2012/0308429 | A1 | 12/2012 | Aruga et al. | |

FOREIGN PATENT DOCUMENTS

| | | | |
|---|---|---|---|
| DE | 10 2005 002 763 | A1 | 8/2005 |
| DE | 10 2010 007 841 | A1 | 8/2011 |
| EP | 2 241 643 | A1 | 10/2010 |
| JP | 2011-252215 | | 12/2011 |
| JP | 2012-89638 | | 5/2012 |

* cited by examiner

*Primary Examiner* — Daniel J Schleis
(74) *Attorney, Agent, or Firm* — Oblon, McClelland, Maier & Neustadt, L.L.P.

(57) ABSTRACT

Provided is a lead frame made of a Cu—Fe-based copper alloy strip to improve the heat dissipation in an LED package. An Ag plating reflective film formed on the lead frame enhances the brightness of the LED package. In the Cu—Fe-based copper alloy strip, arithmetic mean roughness Ra is 0.2 μm or less, ten-point mean roughness $Rz_{JIS}$ is 1.2 μm or less, and maximum height roughness Rz is 1.5 μm or less and depressions having an average length in a rolling parallel direction of 2 to 100 μm, an average length in the rolling vertical direction of 1-30 μm, and a maximum depth along the rolling parallel direction of 400 nm or less. The Cu—Fe-based copper alloy strip contains 1.8-2.6 mass % of Fe, 0.005-0.20 mass % of P, and 0.01-0.50 mass % of Zn or contains 0.01-0.5 mass % of Fe, 0.01-0.20 mass % of P, 0.01-1.0 mass % of Zn, and 0.01-0.15 mass % of Sn.

16 Claims, 1 Drawing Sheet

SCHEMATIC DIAGRAM OF RAW MATERIAL SURFACE

SCHEMATIC DIAGRAM OF RAW MATERIAL SURFACE

COPPER ALLOY STRIP FOR LEAD FRAME OF LED

FIELD OF INVENTION

The present invention relates to a copper alloy strip (plate and strip) used as, e.g., the lead frame of an LED.

BACKGROUND OF INVENTION

In recent years, because of its energy-saving property and long life, a light emitting device using a Light Emitting Diode (LED) as a light source has been prevalent in a wide range of fields. An LED element is fixed to a copper alloy lead frame having excellent thermal and electrical conductivities and embedded in a package. To efficiently retrieve light emitted from the LED element, an Ag plating coating is formed as a reflective film on the surface of the copper alloy lead frame. As a copper alloy for a lead frame for LED, C194 having a strength of about 450 N/mm$^2$ and an electrical conductivity of about 70% IACS is frequently used (see Patent Documents 1 and 2).

To enhance the brightness of an LED package, there are a method which enhances the brightness of an LED element and a method which increases the quality (reflectance) of Ag plating. However, the brightness of the LED element has been enhanced almost to the limit and only a slight increase in brightness results in a significant increase in element cost. As a result, in recent years, there has been strong demand for the increased reflectance of the Ag plating.

On the other hand, under the great influence of the surface state of a copper alloy raw material, the Ag plating is likely to develop a defect which inhibits the reflection property of the Ag plating, such as a projection, non-deposition, or a streaky pattern. In particular, the C194 used frequently for a copper alloy lead frame for LED contains Fe, Fe—P, or Fe—P—O grains in the raw material thereof so that these grains exposed at the surface thereof cause the Ag plating defect mentioned above, which degrades the reflectance of the Ag plating.

In addition, a high-brightness LED used mainly for illumination emits a large amount of heat against all expectations and the emitted heat may degrade the LED element or the resin therearound and impair a long life, which is an advantageous feature of the LED. Accordingly, measures against heat dissipated from the LED are considered to be important. As one of the measures against the heat dissipation, an LED lead frame having an electrical conductivity (thermal conductivity) higher than that of the C194 mentioned above has been in demand.

CITATION LIST

Patent Document

Patent Document 1: Japanese Unexamined Patent Application Publication No. 2011-252215

Patent Document 2: Japanese Unexamined Patent Application Publication No. 2012-89638 (Paragraph 0058)

SUMMARY OF INVENTION

Technical Problem

An object of the present invention is to improve the reflectance of an Ag plating reflective film formed on a surface of a lead frame made of a C194-based (Cu—Fe-based copper alloy) strip and enhance the brightness of an LED package. A further object of the present invention is to use a Cu—Fe—P-based copper alloy having an electrical conductivity higher than that of C194 as part of countermeasures against heat dissipation from the LED package as the raw material of the lead frame to thus improve the reflectance of the Ag plating reflective film formed on the surface thereof and enhance the brightness of the LED package.

Solution to Problem

The present invention relates to a Cu—Fe-based copper alloy strip (plate and strip) for the lead frame of an LED in which the reflectance of an Ag plating reflective film has been improved by adjusting the surface form thereof. In the Cu—Fe-based copper alloy strip for the lead frame, a surface roughness in a rolling vertical direction is such that Ra is 0.2 μm or less, $Rz_{JIS}$ is 1.2 μm or less, and Rz is 1.5 μm or less and depressions having an average length in a rolling parallel direction of 2 to 100 μm, an average length in a rolling vertical direction of 1 to 30 μm, and a maximum depth along the rolling parallel direction of 400 nm or less are densely formed. Note that Ra is an arithmetic mean roughness, $Rz_{JIS}$ is a ten point mean roughness, and Rz is a maximum height roughness.

The foregoing C194-based copper alloy (Cu—Fe-based copper alloy) contains 1.8 to 2.6 mass % of Fe, 0.005 to 0.20 mass % of P, and 0.01 to 0.50 mass % of Zn, with the balance being Cu and an unavoidable impurity. As necessary, the C194-based copper alloy contains a total of 0.3 mass % or less of one or two or more of Sn, Co, Al, Cr, Mg, Mn, Ca, Pb, Ni, Ti, and Zr.

Alternatively, the foregoing Cu—Fe—P-based copper alloy contains 0.01 to 0.5 mass % of Fe, 0.01 to 0.20 mass % of P, 0.01 to 1.0 mass % of Zn, and 0.01 to 0.15 mass % of Sn, with the balance being Cu and an unavoidable impurity. As necessary, the Cu—Fe—P-based copper alloy contains a total of 0.3 mass % or less of one or two or more of Co, Al, Cr, Mg, Mn, Ca, Pb, Ni, Ti, Zr, Si, and Ag.

In a strip of the foregoing Cu—Fe—P-based copper alloy, it is preferable that Fe, Fe—P, or Fe—P—O grains exposed at a surface thereof have grain sizes of 5 μm or less and those of the exposed grains having grain sizes of 1 μm or more are at a density of 3000 grains/mm$^2$ or less. Note that the size of each of the grains indicates the diameter of a circumscribed circle of the grain.

Advantageous Effects of Invention

According to the present invention, the lead frame having a high electrical conductivity (thermal conductivity) serves as a heat dissipation path to allow an improvement in the heat dissipation property of the LED package. In addition, it is possible to improve the reflectance of an Ag plating reflective film formed on the surface of the lead frame made of the Cu—Fe—P-based copper alloy strip and enhance the brightness of the LED package.

DETAILED DESCRIPTION OF THE PREFERRED EMBODIMENTS

Figure 1:
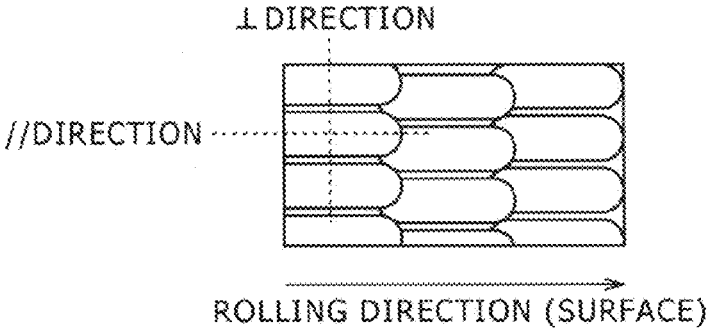
FIG. 1 is a schematic diagram showing the surface form of a copper alloy strip according to the present invention.

Subsequently, referring to FIGS. 1 to 5, a more specific description will be given of the present invention.

(Surface Form of Copper Alloy Strip)

An improvement in the reflection property of an Ag plating film as a reflective film is affected by the surface form of a copper alloy strip as a base material. First, numerous fine depressions are densely formed in the entire surface of the copper alloy strip along the rolling parallel direction thereof to thus cause light emitted from an element to be uniformly dispersed and reflected to allow an improvement in reflectance.

At this time, the surface roughness of the copper alloy strip in a rolling vertical direction thereof needs to be such that an arithmetic surface roughness Ra is 0.2 μm or less, a ten point surface roughness $Rz_{JIS}$ is 1.2 μm or less, and a maximum height roughness Rz is 1.5 μm or less. When Ra is more than 0.2 μm, the reflection of light by the Ag plating film loses direction and is not sufficient to uniformly scatter the light, so that the reflectance cannot be improved. Likewise, when $Rz_{JIS}$ is more than 1.2 μm or Rz is more than 1.5 μm also, a sufficient reflectance cannot be obtained.

The depressions densely present in the surface of the copper alloy strip need to have an average length in the rolling parallel direction of 2 to 100 μm, an average length in the rolling vertical direction of 1 to 30 μm, and a maximum depth along the rolling parallel direction of 400 nm or less. As shown in the schematic diagram of FIG. 1, depressions 1 are densely present in the surface of the copper alloy strip and the ridges of an AFM profile described later serve as the boundaries therebetween.

When the average length in the rolling parallel direction is less than 2 μm or more than 100 μm, the uniform scattering of the light by the Ag plating film is not sufficient, so that a high reflectance cannot be obtained. The average length of the depressions in the rolling parallel direction is preferably 8 to 50 μm, and more preferably 10 to 30 μm. When the average length of the depressions in the rolling vertical direction is less than 1 μm or more than 30 μm also, the uniform scattering of the light by the Ag plating film is not sufficient, so that a high reflectance cannot be obtained. The average length of the depressions in the rolling vertical direction is preferably 3 to 15 μm, and more preferably 4 to 10 μm. When the depths of the depressions measured in the rolling parallel direction are more than 400 nm also, the uniform scattering of the light by the Ag plating film is not sufficient, so that a high reflectance cannot be obtained. The depths of the depressions are preferably 50 to 200 nm, and more preferably 70 to 150 nm.

The grains exposed at the outermost surface of the C194-based (Cu—Fe-based) copper alloy are made of Fe, Fe—P, or Fe—P—O. When the grain sizes (diameters of the circumscribed circles thereof) of the exposed portions of the grains exceed 5 μm or when the grains having the exposed portions having the grain sizes of 1 μm or more are present at a density of more than 3000 grains/mm$^2$, an Ag plating defect such as a projection or non-deposition occurs to cause the degradation of the reflection property of the Ag plating coating.

In the Cu—Fe—P-based copper alloy according to the present invention, grains made of Fe, Fe—P, Fe—P—O, or the like are exposed at the outermost surface of the strip. When the grain sizes (diameters of the circumscribed circles thereof) of the exposed portions of these grains are more than 5 μm or when the grains having the exposed portions having the grain sizes of 1 μm or more are present at a density of more than 2000 grains/mm$^2$, an Ag plating defect such as a projection or non-deposition may possibly occur. Therefore, in the copper alloy strip according to the present invention, it is preferable that the grain sizes of the exposed portions of the grains made of Fe, Fe—P, Fe—P—O, or the like exposed at the outermost surface are 5 μm or less and those of the grains having the exposed portions having the grain sizes of 1 μm or more are at a density of 2000 grains/mm$^2$ or less.

(C194-based (Cu—Fe-based) Copper Alloy)

The C194-based (Cu—Fe-based) copper alloy according to the present invention contains 1.8 to 2.6 mass % of Fe, 0.005 to 0.20 mass % of P, and 0.01 to 0.50 mass % of Zn, with the balance being Cu and an unavoidable impurity. As necessary, the C194-based copper alloy contains a total of 0.3 mass % or less of one or two or more of Sn, Co, Al, Cr, Mg, Mn, Ca, Pb, Ni, Ti, and Zr.

In the foregoing C194-based (Cu—Fe-based) copper alloy, Fe functions to form a compound with P and improve the strength and electrical conductivity property thereof. However, when the content of Fe is more than 2.6 mass %, Fe which cannot be solid-solved at the time of dissolution remains as crystallized materials. Of the crystallized materials, the larger ones have grain sizes of several tens of micrometers or more and exposed at the surface of the copper alloy strip to cause the Ag plating defect. However, when the content of Fe is less than 1.8 mass %, the lead frame for LED cannot have a sufficient strength. On the other hand, when the content of P is more than 0.2 mass %, the thermal and electrical conductivities of the lead frame for LED are degraded while, when the content of P is less than 0.005 mass %, the frame for LED cannot have a sufficient strength.

In the foregoing C194-based (Cu—Fe-based) copper alloy, Zn acts to improve the thermal peeling resistance of a solder and functions to maintain solder junction reliability when the LED package is attached to a base plate. When the content of Zn is less than 0.01 mass %, it is insufficient to satisfy the thermal peeling resistance required of the solder while, when the content of Zn is more than 0.50 mass %, the thermal and electrical conductivities are degraded.

In the foregoing C194-based (Cu—Fe-based) copper alloy, Sn, Co, Al, Cr, Mg, Mn, Ca, Pb, Ni, Ti, and Zr also have the function of improving the strength and heat resistance of the copper alloy and further improving the hot rolling property during the production thereof. To obtain the foregoing function by adding such elements to the copper alloy, it is desirable that the total content thereof is 0.02 mass % or more. However, when the total content of such components is more than 0.3 mass %, the thermal and electrical conductivities are degraded.

(Cu—Fe—P-Based Copper Alloy)

A Cu—Fe—P-based copper alloy according to the present invention contains 0.01 to 0.5 mass % of Fe, 0.01 to 0.20 mass % of P, 0.01 to 1.0 mass % of Zn, and 0.01 to 0.15 mass % of Sn, with the balance being Cu and an unavoidable impurity. As necessary, the Cu—Fe—P-based copper alloy contains a total of 0.3 mass % or less of one or two or more of Co, Al, Cr, Mg, Mn, Ca, Pb, Ni, Ti, Zr, Si, and Ag.

In the foregoing Cu—Fe—P-based copper alloy, Fe has the function of forming a compound with P and improving the strength and electrical conductivity property thereof. However, when the content of Fe is more than 0.5 mass %, it causes the degradation of the electrical and thermal conductivities of the copper alloy while, when the content of Fe is less than 0.01 mass %, the lead frame for LED cannot have a sufficient strength. On the other hand, when the content of P is more than 0.2 mass %, the electrical and thermal conductivities of the copper alloy are degraded while, when the content of P is less than 0.01 mass %, the lead frame for LED cannot have a strength required thereof.

In the foregoing Cu—Fe—P-based copper alloy, Zn acts to improve the thermal peeling resistance of a solder and functions to maintain solder junction reliability when the LED package is attached to a base plate. When the content of Zn is less than 0.01 mass %, it is insufficient to satisfy the thermal peeling resistance required of the solder while, when the content of Zn is more than 1.0 mass %, the thermal and electrical conductivities of the copper alloy are degraded.

Sn contributes to an improvement in the strength of the copper alloy but, when the content thereof is less than 0.01 mass %, a sufficient strength cannot be obtained. On the other hand, when the content of Sn is more than 0.15 mass %, the electrical and thermal conductivities of the copper alloy are degraded.

In the foregoing Cu—Fe—P-based copper alloy, Co, Al, Cr, Mg, Mn, Ca, Pb, Ni, Ti, Zr, Si, and Ag also have the function of improving the strength and heat resistance of the copper alloy and further improving the hot rolling property during the production thereof. To obtain the foregoing function by adding such elements to the copper alloy, it is desirable that the total content thereof is 0.02 mass % or more. However, when the total content of such components is more than 0.3 mass %, the thermal and electrical conductivities are degraded.

(Method of Producing Copper Alloy Strip)

Each of C194 copper alloy strip and a Cu—Fe—P-based copper alloy strip is typically produced by successively subjecting an ingot to facing, hot rolling, post-hot-rolling rapid cooling or solution treatment, subsequent cold rolling, precipitation annealing, and finishing cold rolling. The cold rolling and the precipitation annealing are repeated as necessary, and low-temperature annealing is performed as necessary after the finishing cold rolling. In the case of the copper alloy strip according to the present invention also, the production process need not be significantly changed. On the other hand, coarse Fe, Fe—P, or Fe—P—O grains are formed mainly during melting/casting and during hot rolling so that it is necessary to select proper conditions for the melting/casting and the hot rolling, which are specifically as follows.

In the melting/casting, Fe is added to a copper alloy molten metal at 1200 C.° or more to be dissolved therein and cast, while the temperature of the molten metal is also held thereafter at 1200 C.° or more. The resulting ingot is cooled at a cooling speed of 1 C.°/second or more even during solidification (when a solid and a liquid coexist) and after solidification. To accomplish this, in the case of continuous casting or semi-continuous casting, it is necessary to sufficiently efficiently perform primary cooling in a mold and secondary cooling immediately under the mold. In the hot rolling, homogenization treatment is performed at 900 C.° or more, and preferably 950 C.° or more, the hot rolling is started at the temperature, the temperature at which the hot rolling is ended is adjusted to be 650 C.° or more, and preferably 700 C.° or more and, immediately after the hot rolling is ended, rapid cooling is performed to 300 C.° or less using a large amount of water.

The surface form (surface roughness or depressed portions) of the copper alloy strip according to the present invention is formed by transferring the surface shape of a rolling roll to the copper alloy strip in the finishing cold rolling. In other words, the rolling roll needs to have extremely fine dull patterns corresponding to the foregoing surface form in the surface thereof. As the rolling roll, a silicon-nitride-based roll made of SiAlON or the like is used. While the roll is rotated and moved in parallel with the axial direction thereof, an ultra-abrasive wheel having diamond abrasive grains is rotated in the same direction and pressed thereagainst (the contact surface moves in the opposite direction) to grind the surface of the roll and form the dull patterns. By varying the grain sizes of the diamond abrasive grains, the distribution density thereof, the force with which the ultra-abrasive wheel is pressed, and the rotation speed and movement speed of the roll, it is possible to form extremely fine indentations having different roughnesses (lengths, widths, and heights), i.e., the dull patterns in the surface of the roll.

In the finishing cold rolling, using a roll having a roll diameter of about 20 to 100 mm, a total of 20 to 70% cold rolling is performed by one pass of threading or a plurality of passes of threading. When the plurality of passes of threading is performed, it is desirable to provide a SiAlON roll for the first pass with dull patterns coarser than the dull patterns of a roll for the second and subsequent passes and control the rolling speed such that the rolling speed is lower during the second and subsequent passes than during the first pass. As the rolling speed is lower, the dull pattern of the roll is more distinctly transferred into the surface of the copper alloy strip and, as the roll diameter is smaller, more stable transfer can be performed. In addition, since the material of the silicon-nitride-based roll is hard and unlikely to be deformed, it can be considered that the dull patterns of the roll are distinctly transferred into the surface of the copper alloy strip. At present, the copper alloy strip having the surface form (especially the depressed portions densely formed) prescribed in the present invention can be obtained only by performing the finishing cold rolling using the silicon-nitride-based roll having the surface ground with the ultra-abrasive wheel.

EXAMPLES

Copper alloys having the compositions shown in Tables 1 to 4 were each melted under a charcoal coating in atmospheric air in a small-sized electric furnace to produce ingots each having a thickness of 50 mm, a width of 80 mm, and a length of 180 mm by melting. After facing each of the top/back surfaces of the produced ingots mentioned above by 5 mm, post-homogenization-treatment hot rolling is performed at 950° C. to form the foregoing ingots into plate materials each having a thickness of 12 mm, which were rapidly cooled from a temperature of 700° C. or more. Each of the top/back surfaces of the plate materials was faced by about 1 mm. After repeatedly performing cold rolling and precipitation annealing at 500 to 550° C. for 2 to 5 hours, using SiAlON rolls each having dull patterns formed in the surface thereof and a diameter of 50 mm (using normal high-speed steel rolls without dull patterns only for Nos. 33 and 130), finishing cold rolling was performed with a 40% processing rate to produce copper alloy plates/strips each having a thickness of 0.2 mm, which were used as samples.

TABLE 1

| No. | | Chemical Composition (mass %) Fe | P | Zn | Others | Tensile Strength ($N/mm^2$) | Electrical Conductivity (% IACS) | Solder Thermal Peeling Resistance |
|---|---|---|---|---|---|---|---|---|
| Examples | 1 | 2.2 | 0.03 | 0.15 | — | 451 | 71 | Passed |
| | 2 | 2.6 | 0.03 | 0.15 | — | 473 | 69 | Passed |
| | 3 | 1.8 | 0.03 | 0.15 | — | 429 | 73 | Passed |
| | 4 | 2.2 | 0.2 | 0.15 | — | 479 | 73 | Passed |
| | 5 | 2.2 | 0.005 | 0.15 | — | 432 | 69 | Passed |
| | 6 | 2.2 | 0.03 | 0.5 | — | 460 | 68 | Passed |
| | 7 | 2.2 | 0.03 | 0.01 | — | 448 | 71 | Passed |
| | 8 | 2.6 | 0.2 | 0.15 | — | 492 | 71 | Passed |
| | 9 | 1.8 | 0.005 | 0.15 | — | 421 | 71 | Passed |
| | 10 | 2.2 | 0.03 | 0.15 | Sn: 0.15, Co: 0.1 | 460 | 68 | Passed |
| | 11 | 2.2 | 0.03 | 0.15 | Sn: 0.10, Cr: 0.05 | 456 | 69 | Passed |
| | 12 | 2.2 | 0.03 | 0.15 | Sn: 0.05, Mn: 0.05 | 447 | 72 | Passed |
| | 13 | 2.2 | 0.03 | 0.15 | Mn: 0.07, Cr: 0.08, Ni: 0.05 | 458 | 68 | Passed |
| | 14 | 2.2 | 0.03 | 0.15 | — | 451 | 71 | Passed |
| | 15 | 2.2 | 0.03 | 0.15 | — | 451 | 71 | Passed |
| | 16 | 2.2 | 0.03 | 0.15 | — | 451 | 71 | Passed |
| | 17 | 2.2 | 0.03 | 0.15 | — | 451 | 71 | Passed |
| | 18 | 2.2 | 0.03 | 0.15 | — | 451 | 71 | Passed |
| | 19 | 2.2 | 0.03 | 0.15 | — | 451 | 71 | Passed |
| | 20 | 2.1 | 0.025 | 0.20 | Zr: 0.03, Ti: 0.01, Mg: 0.01, Pb: 0.01 | 448 | 72 | Passed |
| | 21 | 2.15 | 0.033 | 0.30 | Ca: 0.01, Al: 0.02, Mg: 0.01 | 455 | 70 | Passed |

TABLE 2

| No. | | Chemical Composition (mass %) Fe | P | Zn | Others | Tensile Strength ($N/mm^2$) | Electrical Conductivity (% IACS) | Solder Thermal Peeling Resistance |
|---|---|---|---|---|---|---|---|---|
| Comparative Examples | 22 | 3.0* | 0.03 | 0.15 | — | 482 | 65 | Passed |
| | 23 | 1.5* | 0.03 | 0.15 | — | 396* | 73 | Passed |
| | 24 | 2.2 | 0.3* | 0.15 | — | 503 | 63* | Passed |
| | 25 | 2.2 | 0.002* | 0.15 | — | 428 | 64* | Passed |
| | 26 | 2.2 | 0.03 | 1.0* | — | 468 | 63* | Passed |
| | 27 | 2.2 | 0.03 | 0.002* | — | 447 | 70 | Failed |
| | 28 | 3.0* | 0.3* | 0.15 | — | 511 | 61* | Passed |
| | 29 | 1.5* | 0.002* | 0.15 | — | 390* | 71 | Passed |
| | 30 | 2.2 | 0.03 | 0.15 | Sn: 0.1, Cr: 0.1, Mn: 0.15, Ni: 0.1, Co: 0.05* | 470 | 64* | Passed |
| | 31 | 2.2 | 0.03 | 0.15 | Sn: 0.5* | 485 | 53* | Passed |
| | 32 | 2.2 | 0.03 | 0.15 | Sn: 0.05, Pb: 0.03, Zr: 0.05, Al: 0.05, Co: 0.12, Ni: 0.05* | 468 | 64* | Passed |
| | 33 | 2.2 | 0.03 | 0.15 | — | 451 | 71 | Passed |
| | 34 | 2.2 | 0.03 | 0.15 | — | 451 | 71 | Passed |
| | 35 | 2.2 | 0.03 | 0.15 | — | 451 | 71 | Passed |
| | 36 | 2.2 | 0.03 | 0.15 | — | 451 | 71 | Passed |
| | 37 | 2.2 | 0.03 | 0.15 | — | 451 | 71 | Passed |
| | 38 | 2.2 | 0.03 | 0.15 | — | 451 | 71 | Passed |
| | 39 | 2.2 | 0.03 | 0.15 | — | 451 | 71 | Passed |
| | 40 | 2.2 | 0.03 | 0.15 | — | 451 | 71 | Passed |

*Portion where content of element is excessive or insufficient or where characteristic is inferior

TABLE 3

| No. | | Chemical Composition (mass %) Fe | P | Zn | Sn | Others | Tensile Strength ($N/mm^2$) | Electrical Conductivity (% IACS) | Solder Thermal Peeling Resistance |
|---|---|---|---|---|---|---|---|---|---|
| Examples | 101 | 0.3 | 0.1 | 0.3 | 0.03 | — | 468 | 87 | Passed |
| | 102 | 0.4 | 0.1 | 0.3 | 0.03 | — | 473 | 85 | Passed |
| | 103 | 0.08 | 0.03 | 0.3 | 0.03 | — | 452 | 90 | Passed |
| | 104 | 0.3 | 0.15 | 0.3 | 0.03 | — | 473 | 82 | Passed |
| | 105 | 0.1 | 0.02 | 0.3 | 0.03 | — | 455 | 89 | Passed |
| | 106 | 0.3 | 0.1 | 0.8 | 0.03 | — | 471 | 85 | Passed |
| | 107 | 0.3 | 0.1 | 0.02 | 0.03 | — | 468 | 88 | Passed |
| | 108 | 0.3 | 0.1 | 0.3 | 0.13 | — | 473 | 85 | Passed |
| | 109 | 0.3 | 0.1 | 0.3 | 0.01 | — | 467 | 88 | Passed |
| | 110 | 0.3 | 0.1 | 0.3 | 0.03 | Co: 0.08, Al: 0.04, Cr: 0.08, Mg: 0.05 | 471 | 81 | Passed |
| | 111 | 0.3 | 0.1 | 0.3 | 0.03 | Mg: 0.02 | 460 | 88 | Passed |
| | 112 | 0.3 | 0.1 | 0.3 | 0.03 | Ni: 0.05, Si: 0.1, Ag: 0.05 | 477 | 82 | Passed |

TABLE 3-continued

| No. | Chemical Composition (mass %) Fe | P | Zn | Sn | Others | Tensile Strength ($N/mm^2$) | Electrical Conductivity (% IACS) | Solder Thermal Peeling Resistance |
|---|---|---|---|---|---|---|---|---|
| 113 | 0.3 | 0.1 | 0.3 | 0.03 | Mn: 0.05, Pb: 0.05 | 470 | 86 | Passed |
| 114 | 0.3 | 0.1 | 0.3 | 0.03 | — | 468 | 87 | Passed |
| 115 | 0.3 | 0.1 | 0.3 | 0.03 | — | 468 | 87 | Passed |
| 116 | 0.3 | 0.1 | 0.3 | 0.03 | — | 468 | 87 | Passed |
| 117 | 0.3 | 0.1 | 0.3 | 0.03 | — | 468 | 87 | Passed |
| 118 | 0.3 | 0.1 | 0.3 | 0.03 | — | 468 | 87 | Passed |
| 119 | 0.3 | 0.1 | 0.3 | 0.03 | — | 468 | 87 | Passed |

TABLE 4

| | No. | Chemical Composition (mass %) Fe | P | Zn | Sn | Others (Note) | Tensile Strength ($N/mm^2$) | Electrical Conductivity (% IACS) | Solder Thermal Peeling Resistance |
|---|---|---|---|---|---|---|---|---|---|
| Comparative Examples | 120 | 1.0* | 0.1 | 0.3 | 0.03 | — | 488 | 79* | Passed |
| | 121 | 0.004* | 0.1 | 0.3 | 0.03 | — | 408* | 64* | Passed |
| | 122 | 0.3 | 0.3* | 0.3 | 0.03 | — | 497 | 45* | Passed |
| | 123 | 0.3 | 0.005* | 0.3 | 0.03 | — | 439* | 86 | Passed |
| | 124 | 0.3 | 0.1 | 1.5* | 0.03 | — | 475 | 76* | Passed |
| | 125 | 0.3 | 0.1 | 0.005* | 0.03 | — | 463 | 88 | Failed |
| | 126 | 0.3 | 0.1 | 0.3 | 0.2* | — | 471 | 77* | Passed |
| | 127 | 0.2 | 0.07 | 0.2 | 0.002* | — | 446* | 88 | Passed |
| | 128 | 0.3 | 0.1 | 0.3 | 0.03 | Co: 0.1, Al: 0.2, Si: 0.1, Mn: 0.1 | 475 | 71* | Passed |
| | 129 | 2.2* | 0.03 | 0.15 | —* | Cr: 0.1, Ti: 0.1 | 451 | 65* | Passed |
| | 130 | 0.3 | 0.1 | 0.3 | 0.03 | — | 468 | 87 | Passed |
| | 131 | 0.3 | 0.1 | 0.3 | 0.03 | — | 468 | 87 | Passed |
| | 132 | 0.3 | 0.1 | 0.3 | 0.03 | — | 468 | 87 | Passed |
| | 133 | 0.3 | 0.1 | 0.3 | 0.03 | — | 468 | 87 | Passed |
| | 134 | 0.3 | 0.1 | 0.3 | 0.03 | — | 468 | 87 | Passed |
| | 135 | 0.3 | 0.1 | 0.3 | 0.03 | — | 468 | 87 | Passed |
| | 136 | 0.3 | 0.1 | 0.3 | 0.03 | — | 468 | 87 | Passed |
| | 137 | 0.3 | 0.1 | 0.3 | 0.03 | — | 468 | 87 | Passed |

*Portion where content of element is excessive or insufficient or where characteristic is inferior Using the produced samples, tests for individually measuring tensile strengths, electrical conductivities, the grain sizes and densities of grains exposed at the surfaces, surface roughnesses, and depressed shapes were performed in the following manner. The measurement results are shown in Tables 1 to 8. However, the tensile strengths of Nos. 14 to 19 and 33 to 40, the electrical conductivities thereof, the grain sizes and densities of the grains exposed at the surfaces thereof were considered to have the same values as those of No. 1 so that the measurement tests therefor were omitted. The tensile strengths of Nos. 114 to 119 and 130 to 137, the electrical conductivities thereof, the grain sizes and densities of the grains exposed at the surfaces thereof were also considered to have the same values as those of No. 101 so that the measurement tests therefor were omitted.

(Measurement of Tensile Strengths)

From the samples, JIS No. 5 specimens were collected by setting a longitudinal direction in parallel with a rolling direction and a tensile test was performed based on the specifications of JIS Z 2241 to measure the tensile strengths. Of the specimens Nos. 1 to 40, those having tensile strengths of 400 $N/mm^2$ or more were determined to have passed the test. Of the specimens Nos. 101 to 137, those having tensile strengths of 450 $N/mm^2$ or more were determined to have passed the test.

(Measurement of Conductivities)

The conductivities were measured based on the specifications of JIS H 0505. Of the specimens Nos. 1 to 40, those having conductivities of 65% IACS or more were determined to have passed the test. Of the specimens Nos. 101 to 137, those having conductivities of 80% IACS or more were determined to have passed the test.

(Measurement of Grain Sizes and Densities of Grains Exposed at Surfaces)

Using the produced samples, 2000-fold magnification SEM observation of the surfaces thereof was performed. The number of Fe, Fe—P, or Fe—P—O grains or inclusions having grain sizes (diameters of circumscribed circles thereof) of 1 μm or more was counted in the range of 100 μm×100 μm, and the number thereof per 1 $mm^2$ was calculated. In addition, the maximum grain size of the foregoing grains or inclusions was measured in the same range.

(Measurement of Surface Roughnesses)

Figure 3:
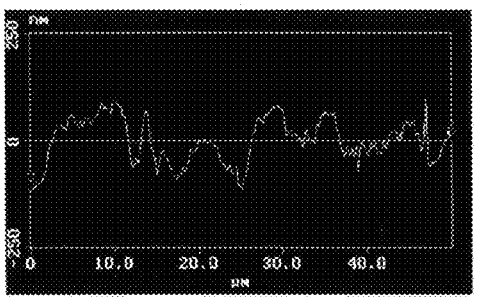
FIG. 3 shows an example of an AFM profile in a rolling vertical direction of the copper alloy strip according to the present invention.
Figure 5:
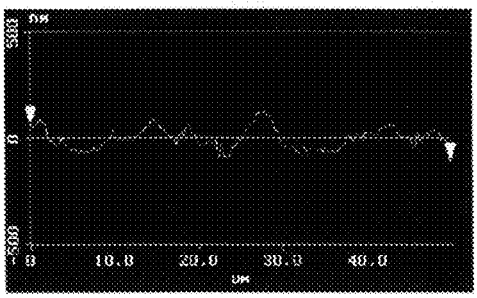
FIG. 5 shows an example of the AFM profile in the rolling vertical direction of the copper alloy strip according to the present invention.

Using the produced samples, the surface states of the samples were observed in a rolling vertical direction by AFM (Atomic Force Microscope) to obtain a surface roughness curve (AFM profile). From the AFM profile, Ra (arithmetic average roughness), $Rz_{JIS}$ (ten point average roughness), and Rz (maximum height roughness) were determined. Examples of the AFM profile in the rolling vertical direction are shown in FIGS. 3 and 5.

(Measurement of Depressed Shapes)

Figure 2:
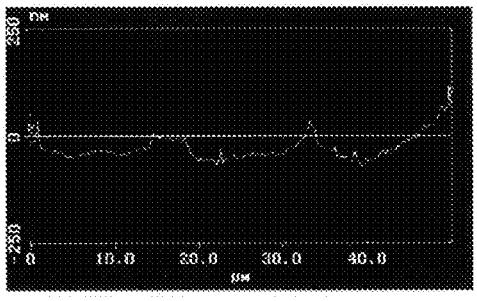
FIG. 2 shows an example of an AFM profile in a rolling parallel direction of the copper alloy strip according to the present invention.
Figure 4:
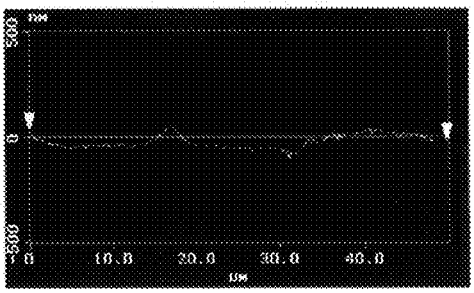
FIG. 4 shows an example of the AFM profile in the rolling parallel direction of the copper alloy strip according to the present invention.

The average length and depth of depressions in a rolling parallel direction were determined from an AFM profile in the rolling parallel direction. Examples of the AFM profile in the rolling parallel direction are shown in FIGS. 2 and 4. As shown in FIGS. 2 and 4, unlike a typical roughness curve from the surface of a copper alloy plate, distinct depressions were formed continuously in the rolling parallel direction. On the other hand, the average length of the depressions in the rolling vertical direction was determined from an AFM profile (see each of FIGS. 3 and 5) in the rolling vertical direction. The measured length of the AMF profile was determined to be 500 μm.

The lengths of the depressions are the distances between the individual ridges of the AFM profile and, in each of the rolling parallel direction and the rolling vertical direction, Rsm (average length of contour curve elements) determined from the AFM profile was regarded as the average length of the depressions. The depths of the depressions were assumed to be the distances between the adjacent ridges and valleys of the AFM profile and the maximum value thereof was assumed to be a maximum depth.

TABLE 5

| | | Sample Surface Roughness | | | Sample Surface Depressions: Average Length | | Sample Surface Depressions: Maximum Depth | Grains Exposed at Sample Surface | | Ag Plating | |
|---|---|---|---|---|---|---|---|---|---|---|---|
| No. | | Ra (μm) | $Rz_{JIS}$ (μm) | Rz (μm) | Rolling// (μm) | Rolling ⊥ (μm) | (nm) | Maximum Diameter (μm) | Number of Grains (Grains/mm$^2$) | Presence/ Absence of Defect | Reflectance (%) |
| Examples | 1 | 0.04 | 0.3 | 0.5 | 13 | 5 | 130 | 3 | 2000 | Absent | 92.0 |
| | 2 | 0.03 | 0.3 | 0.5 | 15 | 6 | 129 | 5 | 2500 | Absent | 91.8 |
| | 3 | 0.05 | 0.4 | 0.6 | 12 | 5 | 133 | 1 | 1700 | Absent | 91.9 |
| | 4 | 0.04 | 0.3 | 0.5 | 13 | 5 | 129 | 2 | 1900 | Absent | 92.0 |
| | 5 | 0.05 | 0.3 | 0.5 | 12 | 5 | 127 | 5 | 2500 | Absent | 91.8 |
| | 6 | 0.04 | 0.5 | 0.7 | 14 | 6 | 135 | 3 | 2000 | Absent | 91.9 |
| | 7 | 0.04 | 0.5 | 0.6 | 13 | 4 | 125 | 3 | 2000 | Absent | 92.0 |
| | 8 | 0.03 | 0.5 | 0.7 | 15 | 5 | 135 | 4 | 2200 | Absent | 92.0 |
| | 9 | 0.04 | 0.4 | 0.6 | 14 | 6 | 130 | 2 | 1900 | Absent | 92.1 |
| | 10 | 0.05 | 0.4 | 0.6 | 12 | 6 | 130 | 3 | 2100 | Absent | 91.9 |
| | 11 | 0.04 | 0.3 | 0.5 | 13 | 6 | 132 | 2 | 1900 | Absent | 91.9 |
| | 12 | 0.04 | 0.4 | 0.6 | 12 | 5 | 133 | 2 | 1900 | Absent | 91.9 |
| | 13 | 0.04 | 0.3 | 0.5 | 13 | 4 | 131 | 3 | 2000 | Absent | 92.0 |
| | 14 | 0.05 | 0.3 | 0.6 | 85 | 6 | 132 | 3 | 2000 | Absent | 90.7 |
| | 15 | 0.05 | 0.3 | 0.5 | 3 | 5 | 132 | 3 | 2000 | Absent | 90.5 |
| | 16 | 0.04 | 0.3 | 0.4 | 14 | 27 | 129 | 3 | 2000 | Absent | 91.4 |
| | 17 | 0.06 | 0.3 | 0.5 | 14 | 2 | 130 | 3 | 2000 | Absent | 90.2 |
| | 18 | 0.15 | 1.2 | 1.4 | 13 | 6 | 352 | 3 | 2000 | Absent | 90.2 |
| | 19 | 0.02 | 0.2 | 0.3 | 12 | 4 | 64 | 3 | 2000 | Absent | 91.6 |
| | 20 | 0.07 | 0.35 | 0.6 | 15 | 8 | 150 | 8 | 1850 | Absent | 91.7 |
| | 21 | 0.06 | 0.25 | 0.55 | 20 | 7 | 160 | 4 | 1800 | Absent | 91.9 |

TABLE 6

| | | Sample Surface Roughness | | | Sample Surface Depressions: Average Length | | Sample Surface Depressions: Maximum Depth | Grains Exposed at Sample Surface | | Ag Plating | |
|---|---|---|---|---|---|---|---|---|---|---|---|
| No. | | Ra (μm) | $Rz_{JIS}$ (μm) | Rz (μm) | Rolling ‖ (μm) | Rolling⊥ (μm) | (nm) | Maximum Diameter (μm) | Number of Grains (Grains/mm$^2$) | Presence/ Absence of Defect | Reflectance (%) |
| Comparative Example | 22 | 0.05 | 0.4 | 0.6 | 13 | 6 | 140 | 20* | 14000* | Present | 88.5* |
| | 23 | 0.03 | 0.3 | 0.4 | 11 | 5 | 125 | 1 | 1700 | Absent | 91.6 |
| | 24 | 0.05 | 0.4 | 0.5 | 16 | 6 | 130 | 2 | 1900 | Absent | 91.8 |
| | 25 | 0.04 | 0.3 | 0.4 | 15 | 5 | 125 | 8* | 3520* | Present | 89.6* |
| | 26 | 0.04 | 0.3 | 0.5 | 13 | 6 | 129 | 3 | 2100 | Absent | 92.0 |
| | 27 | 0.05 | 0.3 | 0.5 | 17 | 5 | 132 | 3 | 2100 | Absent | 91.9 |
| | 28 | 0.04 | 0.3 | 0.5 | 15 | 4 | 128 | 10* | 5100* | Present | 89.3* |
| | 29 | 0.05 | 0.4 | 0.5 | 13 | 7 | 130 | 2 | 1900 | Absent | 91.9 |
| | 30 | 0.05 | 0.4 | 0.5 | 21 | 6 | 134 | 3 | 2500 | Absent | 92.0 |
| | 31 | 0.04 | 0.5 | 0.7 | 14 | 6 | 135 | 3 | 2000 | Absent | 91.9 |
| | 32 | 0.04 | 0.4 | 0.6 | 12 | 5 | 133 | 2 | 2000 | Absent | 91.9 |
| | 33 | 0.06 | 0.3 | 0.3 | — | — | — | 3 | 2000 | Absent | 89.4* |
| | 34 | 0.03 | 0.3 | 0.5 | 130* | 5 | 131 | 3 | 2000 | Absent | 89.0* |
| | 35 | 0.06 | 0.3 | 0.5 | 1* | 6 | 130 | 3 | 2000 | Absent | 87.2* |
| | 36 | 0.04 | 0.3 | 0.5 | 12 | 50* | 131 | 3 | 2000 | Absent | 89.4* |
| | 37 | 0.04 | 0.3 | 0.5 | 13 | 0.5* | 129 | 3 | 2000 | Absent | 87.3* |
| | 38 | 0.26* | 2.4* | 2.6* | 14 | 4 | 600* | 3 | 2000 | Absent | 85.2* |
| | 39 | 0.22* | 2.0* | 2.2* | 13 | 4 | 440* | 3 | 2000 | Absent | 88.6* |
| | 40 | 0.17 | 1.4* | 1.7* | 12 | 5 | 393 | 3 | 2000 | Absent | 89.1* |

*Portion not satisfying prescription or having inferior characteristic

TABLE 7

| | | Surface Roughness of Sample | | | Surface Depressions of Sample: Average Length | | Surface Depressions of Sample: Maximum | Grains Exposed at Sample Surface | | Ag Plating | |
|---|---|---|---|---|---|---|---|---|---|---|---|
| No. | | Ra (μm) | $Rz_{JIS}$ (μm) | Rz (μm) | Rolling// (μm) | Rolling ⊥ (μm) | Depth (nm) | Maximum Diameter (μm) | Number of Grains (Grains/mm$^2$) | Presence/ Absence of Defect | Reflectance (%) |
| Examples | 101 | 0.04 | 0.3 | 0.5 | 13 | 5 | 130 | — | 0 | Absent | 92.2 |
| | 102 | 0.05 | 0.3 | 0.5 | 12 | 6 | 128 | — | 0 | Absent | 92.0 |
| | 103 | 0.04 | 0.4 | 0.6 | 15 | 7 | 131 | — | 0 | Absent | 92.1 |
| | 104 | 0.03 | 0.5 | 0.7 | 18 | 4 | 135 | — | 0 | Absent | 92.1 |
| | 105 | 0.05 | 0.4 | 0.6 | 11 | 6 | 133 | — | 0 | Absent | 92.2 |
| | 106 | 0.04 | 0.5 | 0.7 | 12 | 8 | 136 | — | 0 | Absent | 92.1 |
| | 107 | 0.03 | 0.3 | 0.5 | 16 | 6 | 132 | — | 0 | Absent | 92.0 |
| | 108 | 0.04 | 0.3 | 0.5 | 15 | 4 | 129 | — | 0 | Absent | 92.1 |
| | 109 | 0.04 | 0.4 | 0.6 | 17 | 6 | 125 | — | 0 | Absent | 91.9 |
| | 110 | 0.05 | 0.4 | 0.6 | 11 | 6 | 130 | — | 0 | Absent | 92.1 |
| | 111 | 0.04 | 0.3 | 0.5 | 13 | 6 | 140 | — | 0 | Absent | 91.9 |
| | 112 | 0.04 | 0.4 | 0.6 | 12 | 5 | 135 | — | 0 | Absent | 92.0 |
| | 113 | 0.04 | 0.3 | 0.5 | 12 | 4 | 132 | — | 0 | Absent | 91.9 |
| | 114 | 0.05 | 0.3 | 0.5 | 87 | 6 | 131 | — | 0 | Absent | 90.8 |
| | 115 | 0.05 | 0.3 | 0.6 | 2 | 6 | 131 | — | 0 | Absent | 90.7 |
| | 116 | 0.05 | 0.3 | 0.4 | 15 | 25 | 129 | — | 0 | Absent | 91.5 |
| | 117 | 0.06 | 0.3 | 0.5 | 14 | 2 | 132 | — | 0 | Absent | 90.3 |
| | 118 | 0.15 | 1.2 | 1.5 | 14 | 5 | 355 | — | 0 | Absent | 90.1 |
| | 119 | 0.02 | 0.2 | 0.2 | 13 | 5 | 58 | — | 0 | Absent | 91.9 |

TABLE 8

| | | Surface Roughness of Sample | | | Surface Depressions of Sample: Average Length | | Surface Depressions of Sample: Maximum | Grains Exposed at Sample Surface | | Ag Plating | |
|---|---|---|---|---|---|---|---|---|---|---|---|
| No. | | Ra (μm) | $Rz_{JIS}$ (μm) | Rz (μm) | Rolling// (μm) | Rolling⊥ (μm) | Depth (nm) | Maximum Diameter (μm) | Number of Grains (Grains/mm$^2$) | Presence/ Absence of Defect | Reflectance (%) |
| Comparative Examples | 120 | 0.05 | 0.4 | 0.5 | 14 | 6 | 128 | 1 | 300 | Absent | 92.0 |
| | 121 | 0.04 | 0.4 | 0.5 | 13 | 9 | 131 | — | 0 | Absent | 92.2 |
| | 122 | 0.04 | 0.4 | 0.5 | 17 | 8 | 136 | — | 0 | Absent | 92.1 |
| | 123 | 0.04 | 0.4 | 0.5 | 13 | 7 | 129 | 1 | 100 | Absent | 92.1 |
| | 124 | 0.03 | 0.3 | 0.4 | 15 | 7 | 130 | — | 0 | Absent | 92.2 |
| | 125 | 0.03 | 0.3 | 0.4 | 14 | 6 | 126 | — | 0 | Absent | 92.0 |
| | 126 | 0.05 | 0.4 | 0.5 | 19 | 7 | 129 | — | 0 | Absent | 92.0 |
| | 127 | 0.04 | 0.4 | 0.5 | 14 | 7 | 133 | — | 0 | Absent | 92.1 |
| | 128 | 0.03 | 0.3 | 0.5 | 15 | 7 | 131 | — | 150 | Absent | 92.2 |
| | 129 | 0.04 | 0.4 | 0.5 | 13 | 7 | 129 | 3 | 2000 | Absent | 92.0 |
| | 130 | 0.06 | 0.3 | 0.4 | — | — | — | — | 0 | Absent | 89.4* |
| | 131 | 0.03 | 0.3 | 0.5 | 133* | 5 | 128 | — | 0 | Absent | 89.2* |
| | 132 | 0.06 | 0.3 | 0.6 | 1* | 6 | 132 | — | 0 | Absent | 87.1* |
| | 133 | 0.04 | 0.3 | 0.5 | 14 | 52* | 130 | — | 0 | Absent | 89.3* |
| | 134 | 0.05 | 0.3 | 0.5 | 12 | 0.5* | 128 | — | 0 | Absent | 87.4* |
| | 135 | 0.27* | 2.4* | 2.6* | 14 | 5 | 610* | — | 0 | Absent | 85.3* |
| | 136 | 0.23* | 2.0* | 2.2* | 12 | 5 | 445* | — | 0 | Absent | 88.7* |
| | 137 | 0.16 | 1.4* | 1.7* | 12 | 4 | 390 | — | 0 | Absent | 89.4* |

*Portion not satisfying prescription or having inferior characteristic

Subsequently, Ag plating was performed on the produced samples under the following conditions, and the observation of the presence/absence of an Ag plating defect, a thermal peeling resistance test, and the measurement of the reflectances were performed in the following manner. The measurement results are shown in Tables 1 to 8.

(Ag Plating Conditions)

On each of the samples, electrolytic degreasing (at 5 Adm$^2$ for 60 sec) and acid pickling (with 20 mass % of a sulfuric acid for 5 sec) were performed, and Cu flash plating aiming at an average thickness of 0.1 μm was performed. Thereafter, Ag plating was performed to a thickness of 2.5 μm. The composition of an Ag plating solution is as follows: Ag concentration 80 g/L; free KCN concentration 120 g/L; potassium carbonate concentration 15 g/L; additive (commercially available under the trade name of Ag20-10T from Metalor Technologies SA.) 20 ml/L.

(Presence/Absence of Ag Plating Defect)

By subjecting a surface of Ag plating to SEM observation, the presence/absence of an Ag plating defect (a projection or non-deposition) in the range of 1 mm$^2$ was evaluated.

(Thermal Peeling Resistances)

From each of the samples, a strip-shaped specimen was collected and subjected to soldering. Then, the specimen was held at 150° C. for 1000 hours and the peeling condition of the solder when the strip was bent and straightened was checked. A specimen from which the solder had not peeled was evaluated as passed, while the specimen from which the solder had peeled was evaluated as failed. Note that soldering was performed using a Sn-3 mass % Ag-0.5 mass % Cu solder at a bathing temperature of 260±5° C. for a dipping time of 5 seconds.

(Measurement of Reflectances)

Using a spectrophotometer (CM-600d) commercially available from Konika Minolata Inc., the total reflection index (regular reflectance+diffuse reflectance) of each of the specimens was measured. A specimen having a total reflectance index of 90% or more was evaluated to have passed.

As shown in Tables 1 and 2, in each of Nos. 1 to 21, the alloy composition, the sizes and densities of grains exposed at the surface of the specimen, the surface roughness, the dimensions of the surface depressions, and the like satisfy the prescriptions of the present invention, the tensile strength is large, the electrical conductivity is high, and the solder thermal peeling resistance is excellent. In addition, the reflectance of the Ag plating is higher than that of typical C194 (No. 33) not formed with depressed portions.

Likewise, as shown in Tables 3 and 4, in each of Nos. 101 to 119, the alloy composition, the surface roughness, the dimensions of the surface depressions, and the like satisfy the prescriptions of the present invention, the tensile strength is large, the electrical conductivity is high, and the solder thermal peeling resistance is excellent. In addition, the reflectance of the Ag plating is higher than that of a Cu—Fe—P alloy (No. 130) not formed with depressed portions.

On the other hand, as shown in Table 2, of Nos. 22 to 32 having the alloy compositions falling out of the prescription provided in the present invention, Nos. 23 to 32 are each inferior in any of the tensile strength, the electrical conductivity, and the solder thermal peeing resistance. Also, in Nos. 22, 25, and 28, surface exposed grains have a large maximum grain size and the density of the exposed grains having grain sizes of 1 μm or more is high, resulting in the occurrence of Ag plating defects and low reflectances.

As also shown in Table 4, Nos. 120 to 129 having the alloy compositions falling out of the prescription provided in the present invention are also inferior in any of the tensile strength, the electrical conductivity, and the solder thermal peeling resistance. Note that the specimen No. 129 corresponds to C194.

Nos. 34 to 40 and 131 to 137 have depressions densely formed in the surfaces thereof, but do not satisfy one or two or more of the prescription of the surface roughness and the prescriptions of the average length of the depressions and the maximum depth of the depressions. Accordingly, each of Nos. 34 to 40 and 131 to 137 has a low reflectance.

The present application is based on Japanese Patent Applications (Japanese Patent Application Nos. 2013-067387 and 2013-067467) filed on Mar. 27, 2013, the contents of which are herein incorporated by reference.

What is claimed is:

1. A copper alloy strip, having a surface with depressions;

wherein:

the surface has a surface roughness in a rolling vertical direction such that Ra is 0.2 μm or less, $Rz_{JIS}$ is 1.2 μm or less, and Rz is 1.5 μm or less; and the depressions have an average length in a rolling parallel direction of 2 to 100 μm, an average length in the rolling vertical direction of 1 to 30 μm, and a maximum depth along the rolling parallel direction of 400 nm or less.

2. The copper alloy strip according to claim 1, comprising:

Cu;

1.8 to 2.6 mass % of Fe;

0.005 to 0.20 mass % of P; and 0.01 to 0.50 mass % of Zn.

3. The copper alloy strip according to claim 2, further comprising:

a total of 0.02 to 0.3 mass % of at least one selected from the group consisting of Sn, Co, Al, Cr, Mg, Mn, Ca, Pb, Ni, Ti, and Zr.

4. The copper alloy strip according to claim 1, wherein:

Fe, Fe—P, or Fe—P—O grains exposed at the surface have grain sizes of 5 μm or less; and exposed Fe, Fe—P, or Fe—P—O grains having grain sizes of 1 μm or more are present at a density of 3000 grains/$mm^2$ or less.

5. The copper alloy strip according to claim 1, comprising:

Cu;

0.01 to 0.5 mass % of Fe;

0.01 to 0.20 mass % of P;

0.01 to 1.0 mass % of Zn; and 0.01 to 0.15 mass % of Sn.

6. The copper alloy strip according to claim 5, further comprising:

a total of 0.02 to 0.3 mass % of at least one selected from the group consisting of Co, Al, Cr, Mg, Mn, Ca, Pb, Ni, Ti, Zr, Si, and Ag.

7. The copper alloy strip according to claim 2, wherein:

Fe, Fe—P, or Fe—P—O grains exposed at the surface have grain sizes of 5 μm or less; and exposed Fe, Fe—P, or Fe—P—O grains having grain sizes of 1 μm or more are present at a density of 3000 grains/$mm^2$ or less.

8. The copper alloy strip according to claim 3, wherein:

Fe, Fe—P, or Fe—P—O grains exposed at a surface have grain sizes of 5 μm or less; and exposed Fe, Fe—P, or Fe—P—O grains having grain sizes of 1 μm or more are present at a density of 3000 grains/$mm^2$ or less.

9. A copper alloy strip, having a surface with depressions; wherein:

the surface has a surface roughness in a rolling vertical direction such that Ra is 0.2 μm or less, $Rz_{JIS}$ is 1.2 μm or less, and Rz is 1.5 μm or less;

the depressions are formed adjacently and continuously in a rolling parallel direction and the rolling vertical direction; and the depressions have an average length in the rolling parallel direction of 2 to 100 μm, an average length in the rolling vertical direction of 1 to 30 μm, and a maximum depth along the rolling parallel direction of 400 nm or less.

10. The copper alloy strip according to claim 9, comprising:

Cu;

1.8 to 2.6 mass% of Fe;

0.005 to 0.20 mass% of P; and 0.01 to 0.50 mass% of Zn.

11. The copper alloy strip according to claim 10, further comprising:

a total of 0.02 to 0.3 mass% of at least one selected from the group consisting of Sn, Co, Al, Cr, Mg, Mn, Ca, Pb, Ni, Ti, and Zr.

12. The copper alloy strip according to claim 9, wherein:

Fe, Fe—P, or Fe—P—O grains exposed at the surface have grain sizes of 5 μm or less; and exposed Fe, Fe—P, or Fe—P—O grains having grain sizes of 1 μm or more are present at a density of 3000 grains/$mm^2$ or less.

13. The copper alloy strip according to claim 9, comprising:

Cu:

0.01 to 0.5 mass% of Fe;

0.01 to 0.20 mass% of P;

0.01 to 1.0 mass% of Zn; and 0.01 to 0.15 mass% of Sn.

14. The copper alloy strip according to claim 13, further comprising:

a total of 0.02 to 0.3 mass% of at least one selected from the group consisting of Co, Al, Cr, Mg, Mn, Ca, Pb, Ni, Ti, Zr Si, and Ag.

15. The copper alloy strip according to claim 10, wherein:

Fe, Fe—P, or Fe—P—O grains exposed at the surface have grain sizes of 5 μm or less; and exposed Fe, Fe—P, or Fe—P—O grains having grain sizes of 1 μm or more are present at a density of 3000 grains/$mm^2$ or less.

16. The copper alloy strip according to claim 11, wherein:

Fe, Fe—P, or Fe—P—O grains exposed at a surface have grain sizes of 5 μm or less; and exposed Fe, Fe—P, or Fe—P—O grains having grain sizes of 1 μm or more are present at a density of 3000 grains/$mm^2$ or less.

* * * * *